US007559423B2

(12) United States Patent
Vosloo

(10) Patent No.: US 7,559,423 B2
(45) Date of Patent: Jul. 14, 2009

(54) BAT ACCESS AND STORAGE DEVICE

(75) Inventor: Clint Vosloo, Suwanee, GA (US)

(73) Assignee: Mizuno USA, Norcross, GA (US)

( * ) Notice: Subject to any disclaimer, the term of this patent is extended or adjusted under 35 U.S.C. 154(b) by 367 days.

(21) Appl. No.: 11/200,205

(22) Filed: Aug. 9, 2005

(65) Prior Publication Data

US 2007/0034546 A1 Feb. 15, 2007

(51) Int. Cl.
*B65D 85/20* (2006.01)

(52) U.S. Cl. ..... 206/315.1; 206/579

(58) Field of Classification Search ..... 206/315.1, 206/315.2, 315.9, 379, 443, 579; 190/9, 190/102, 103, 107, 109, 110
See application file for complete search history.

(56) References Cited

U.S. PATENT DOCUMENTS

| | | | | | |
|---|---|---|---|---|---|
| 4,182,391 | A * | 1/1980 | Kjose | 224/581 |
| 4,793,532 | A * | 12/1988 | Cash | 224/584 |
| 5,096,030 | A * | 3/1992 | Espinosa et al. | 190/108 |
| 5,224,602 | A * | 7/1993 | Bettles et al. | 206/579 |
| 5,337,907 | A * | 8/1994 | McKenzie et al. | 211/88.01 |
| 5,588,529 | A | 12/1996 | Speck | |
| 6,000,509 | A * | 12/1999 | Chisholm | 190/109 |
| 6,009,995 | A | 1/2000 | Speck | |
| 6,039,474 | A * | 3/2000 | DeChant | 383/66 |
| 6,168,016 | B1 | 1/2001 | Lawson | |
| 6,334,519 | B1 * | 1/2002 | Tong | 190/107 |
| 6,508,358 | B2 | 1/2003 | Cheng | |
| 6,561,329 | B2 | 5/2003 | Stobbs, II et al. | |
| 6,595,358 | B1 | 7/2003 | Speck | |
| 6,732,863 | B2 | 5/2004 | Speck | |
| 6,966,439 | B2 * | 11/2005 | Weleczki | 206/315.3 |
| 7,077,252 | B2 * | 7/2006 | Sanchez | 190/108 |
| 2006/0037877 | A1 * | 2/2006 | Souza | 206/315.1 |

* cited by examiner

*Primary Examiner*—David T Fidei
(74) *Attorney, Agent, or Firm*—Troutman Sanders; James E. Schutz

(57) ABSTRACT

The present invention provides a bat access and storage device for baseball and softball bats. In an exemplary embodiment, the bat access and storage device includes an athletic equipment bag including a general periphery defining an interior. The athletic equipment bag includes an access communicating with the interior. The bat access and storage device also provides a bat sack including a general body and a bat receptacle carried by the general body. The bat sack is adapted to be received within the interior of the athletic equipment bag via the access for storing multiple bats within the interior. Additionally, the bat sack is adapted to be removed via the access to provide accessibility to multiple bats outside of the athletic equipment bag.

7 Claims, 3 Drawing Sheets

BAT ACCESS AND STORAGE DEVICE

TECHNICAL FIELD

The present invention is generally directed to bat access and storage devices and more particularly to baseball or softball equipment devices adapted to provide efficient accessibility to baseball or softball bats.

BACKGROUND

Ever since the creation of baseball in England in the 18th century, and later the advent of softball, the sports of baseball and softball have been games of everlasting appeal to athletes of all levels and ages. From the first hit in a T-ball league, to casual games in an old-timer league, these sports capture the attention of athletes for many generations. The appeal of these classic sports can be seen worldwide as both baseball and softball are loved by athletes in all regions, including Asia, South America, Europe, and North America. As with many popular sports, the increased interest by athletes has resulted in an intense focus and reliance upon performance sports equipment. Baseball or softball athletes at every competitive level are dependent upon their equipment, and, therefore, athletes must be able to easily store, transport, and access their equipment before, during, and after a game or practice.

Typically, baseball and softball athletes utilize athletic equipment bags to transport gear, including bats, balls, catching gloves, batting gloves, uniforms, caps, protective guards, athletic shoes (cleats or spikes), helmets, glasses, and towels. Athletic equipment bags are generally made of lightweight and flexible materials that provide a functional and attractive means of storing, transporting, and accessing the described athletic equipment.

For example, U.S. Pat. No. 6,732,863 to Speck discloses a baseball/softball equipment bag having inner compartments for storing particular types of equipment. More particularly, the bag disclosed in Speck provides a bat compartment for storing bats. While suitable for its intended purposes, the bat compartment significantly limits athletes by requiring them to manage the entire athletic equipment bag when inserting or removing a bat. It is often difficult for the athlete to overcome the cumbersome nature of the weighty and bulky bag, while attempting to gain access to the bat compartment and then manage the removal or insertion of a bat.

Some athletic equipment bags, such as the one in Speck, enable the athlete to use fence clips to hang the athletic equipment bag in the vertical position to allow more convenient access during a game. While suitable for its intended purposes, it is often difficult or undesired to constantly remove or insert large and heavy bats from the general equipment storage area that is the athletic equipment bag. For this reason and many others, athletes neglect to store the bats, and, consequently, bats are often left randomly about the team playing area, such as the dugout and on-deck circle. This creates a significant problem for athletes, as loose bats on the ground are a hazard and can often result in penalties, or even injuries, during the game. It is important to keep the base running area, batter's box, and on-deck circle clear of any loose bats to prevent an athlete from tripping over a bat. Loose bats can lead to serious injuries when errantly contacted during play.

In addition to restricting bat storage to the athletic equipment bag, most conventional athletic equipment bags provide a single large storage compartment for the bats. When stored in this large storage compartment, the bats often come into contact during transport, sometimes scratching and marking the bats and almost always clanging together during transport to create a great deal of unwanted noise.

Baseball and softball present unique problems to athletes in that they require athletes to change sports equipment and attire at every change of offense possession in the game. When athletes are on offense, they will normally need to quickly access a bat when it is their turn to bat. When they switch to defense, the athletes will need to quickly store their bat in exchange for a hat and baseball or softball catching glove. All of this rapid and repetitive changing of equipment makes it extremely critical that athletes be able to quickly, easily, and efficiently access and store their sports equipment.

It is advantageous for the athlete to have the most convenient and practical manner in which to store baseball or softball bats before, during, and after a game or practice. There is a continuing need for an improved bat access and storage device, which facilitates easier and more efficient storage, access, and transport of baseball and softball equipment, especially bats.

BRIEF SUMMARY

Certain objects, advantages and novel features of the invention will be set forth in part in the description that follows and in part will become apparent to those skilled in the art upon examination of the following or may be learned with the practice of an exemplary embodiment of this invention. The objects and advantages of the invention may be realized and obtained by means of instrumentalities and combinations particularly pointed out in the claims.

An exemplary embodiment of the present invention is a bat access and storage device including an athletic equipment bag including a general periphery defining an interior. The athletic equipment bag includes an access communicating with the interior. The bat access and storage device also includes a bat sack having a general body and a bat receptacle carried by the general body. The bat sack is adapted to be received within the interior of the athletic equipment bag via the access, for storing multiple bats within the interior. Additionally, the bat sack is adapted to be removed via the access to provide accessibility to multiple bats outside of the athletic equipment bag.

BRIEF DESCRIPTION OF THE DRAWINGS

The accompanying drawings, incorporated in and forming a part of the specification, illustrate several aspects of the present invention, and together with the description serve to explain the principles of the invention. In the drawings.

DETAILED DESCRIPTION

Figure 1:
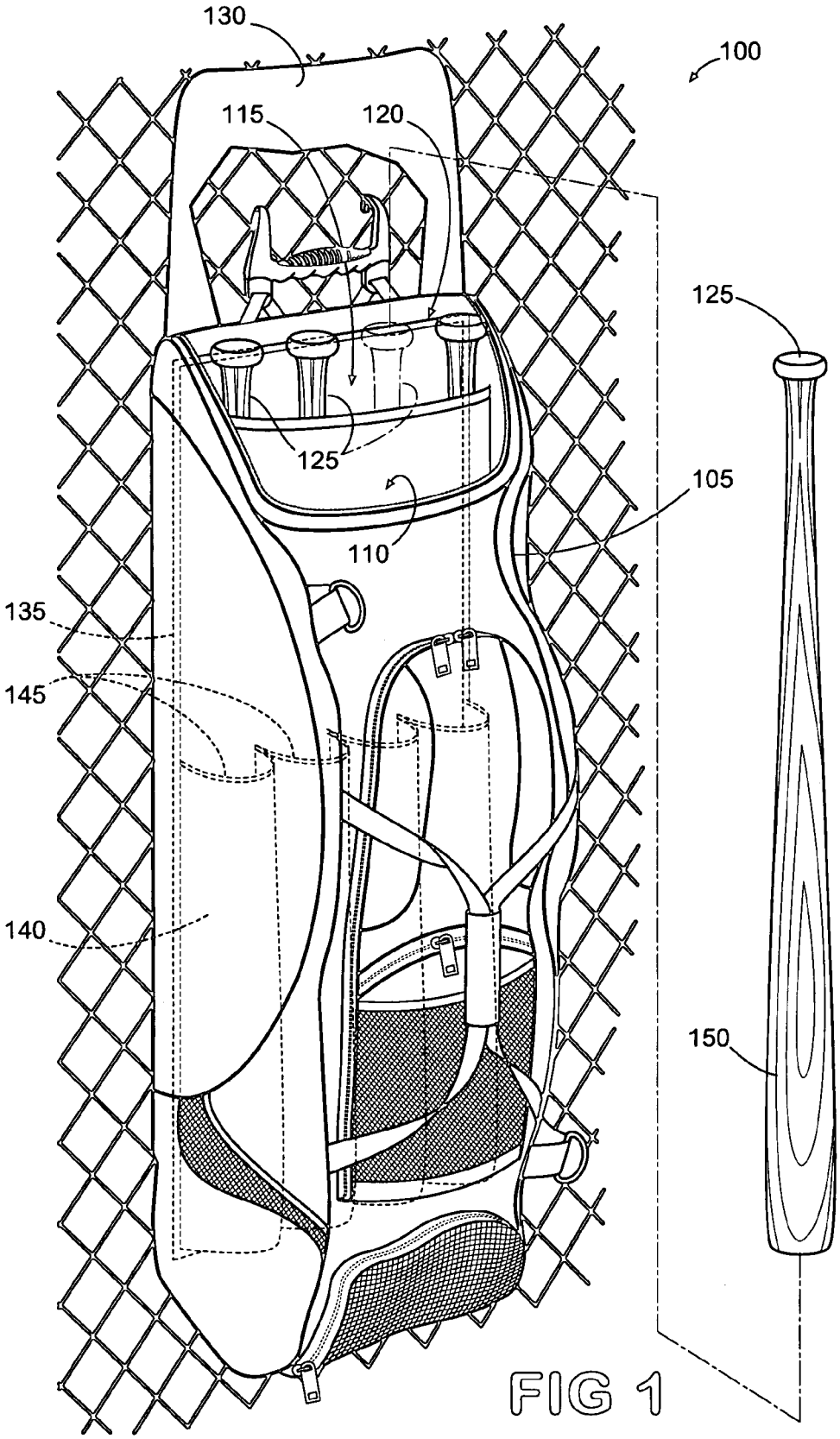
FIG. 1 is an illustration of a bat access and storage device in accordance with some embodiments of the present invention.

Turning now to the figures, in which like numerals refer to like elements through the several figures, FIG. 1 is an illustration of a bat access and storage device 100 in accordance with some embodiments of the present invention. The bat access and storage device 100, in an exemplary embodiment, provides an athletic equipment bag 105. The athletic equipment bag 105 has an elongated rectangular shape and is made of a flexible, durable, and lightweight material. Those skilled in the art will appreciate, however, that the shape, dimensions, or material of the athletic equipment bag 105 can be altered without departing from the scope of the invention. The athletic equipment bag 105, in an exemplary embodiment, has a general periphery defining an interior 110. In an exemplary embodiment, the athletic equipment bag 105 includes an access 115 to the interior 110. The bat access and storage device 100, in an exemplary embodiment, also provides a bat sack 120. The bat sack 120 has a general body 135 and a bat receptacle 140 carried by the body 135. In an exemplary embodiment, the bat sack 120 is adapted to be received within the interior 110 of the athletic equipment bag 105 via the access 115. Inserting the bat sack 120 into the interior 110 allows for multiple bats 125 to be stored in the athletic equipment bag 105. Additionally, in an exemplary embodiment, the bat sack 120 is adapted to be removed via the access 115 and provide accessibility to the bats 125 outside of the athletic equipment bag 105.

In an exemplary embodiment, the access 115 is covered by a panel 130, which can be opened and closed by the athlete by means of a fastening device, such as a zipper or "hook and loop" material. When opened, the panel 130, in some embodiments, can be folded back to reveal an opening to the interior 110. In an alternative embodiment, the access 115 is simply a slit in the athletic equipment bag 105, which provides the athlete with accessibility to the interior 110 of the athletic equipment bag 105. The slit, in some embodiments, can be fastened by a zipper or "hook and loop" material, but in other embodiments is simply an opening in the material making up the athletic equipment bag 105. Those skilled in the art will appreciate that the shape, configuration, or fastening, if necessary, of the access 115 can be implemented in various other ways without departing from the scope of the invention.

It is through the access 115 that the athlete is able to remove and insert the bat sack 120 in an exemplary embodiment. In an exemplary embodiment, the athlete opens the panel 130 and is provided access to the interior 110 of the athletic equipment bag 105. As shown in the exemplary embodiment depicted in FIG. 1, the bat sack 120 is located in the interior 110 of the athletic equipment bag 105. This configuration enables the athlete to store bats 125 within the athletic equipment bag 105. Additionally, when the panel 130 is in the open configuration, the athlete may remove or insert bats 125 into the bat sack 120. Additionally, in the exemplary embodiment, the athlete can remove the bat sack 120 from the athletic equipment bag 105 via the access 115, with the panel 130 open. In an alternative embodiment, in which the access 115 is a silt, the bat sack 120 can be removed from the athletic equipment bag 105 via the slit.

Once removed from the athletic equipment bag 105, the athlete can then access and store bats 125 in the bat sack 120 independent of the athletic equipment bag 105. In an exemplary embodiment, the athlete can re-insert the bat sack 120 into the athletic equipment bag 105 through the access 115 when desired. In a non-limiting example, the athlete may wish to remove the bat sack 120 during a baseball or softball game, and then re-insert bat sack 120 into the athletic equipment bag 105 for transport.

In an exemplary embodiment, the bat receptacle 140 of the bat sack 120 is provided with multiple sleeves 145. Each one of the sleeves 145, in an exemplary embodiment, is a capable of securely storing one individual bat. In an alternative embodiment, the bat receptacle 140 of the bat sack 120 is one large compartment capable of storing multiple bats 125. In another embodiment, the bat receptacle 140 is simply series of clips to which either the upper portion of the bats 125, or the lower portion of the bats 125, can be attached. The clips can be located on the top, middle, or bottom of the general body 135. One of skill in the art will appreciate that the bat receptacle 140 could be provided in numerous other ways without detracting from the scope of the invention.

An exemplary embodiment provides a bat receptacle 140 with multiple sleeves 145, and each of sleeves 145 is enabled to cover at least the barrel 150 of each of the bats 125. In one example embodiment, the sleeves 145 cover only the barrel 150 of each of the bats 125. Wrapping the barrel 150 of the bat in one of the sleeves 145 provides secure control and storage of the bat, by securing the weightiest portion of the bat, while still providing the athlete with the ability to rapidly insert and remove the bat. As the upper portion of the bats 125 tapers inward from the barrel to the handle, the bats 125 do not come into contact during transport even when the sleeves 145 only cover the barrel 150 of each bat. A sleeve the full length of the bat requires the cumbersome manipulation of the bat by threading it through the entire sleeve when inserting it, and pulling the full length of the bat from the entire sleeve when removing it. The same is true for an athletic equipment bag with a bat storage compartment, which requires the full length of the bat to be inserted or the full length of the bat to be removed. Full coverage does not provide rapid access. On the other hand, in this exemplary embodiment, bats 125 can be rapidly inserted and removed because only the barrel 150 is covered. In an alternative embodiment, the sleeves 145 cover more than just the barrel 150 of each bat, but still provide convenient access.

In an exemplary embodiment, the bat sack 120 has a general overall dimension that is at least equivalent to the length of the bat. Therefore, the bat sack 120 is enabled to accommodate the full length of the bats 125 in the exemplary embodiment. In an alternative embodiment, the bat sack 120 is configured to be of a dimension equivalent to the bat receptacle 140. In one non-limiting example embodiment, bat receptacle 140 is simply a series of clips for storing the bats 125, and the bat sack 120 is generally as long as the width of the clips. In an alternative non-limiting example embodiment, the bat receptacle 140 is a number of sleeves 145 and the bat sack 120 is generally as long as the sleeves.

In an exemplary embodiment, the bat sack 120 is made of a flexible, durable, and lightweight material. Those skilled in the art will appreciate, however, that the shape, dimensions, or material of the bat sack 120 can be altered without departing from the scope of the invention. The bat sack 120, in an exemplary embodiment, is generally of a rectangular profile and is of sufficient rigidity to maintain its profile when no bats 125 are contained in the bat receptacle 140. Therefore, the body 135 of the bat sack 120, in this exemplary embodiment, has a sufficiently rigid backing that enables it to hold its shape when empty. In alternative embodiment, the bat sack 120 is made of a non-rigid material which retains its shape when storing a bat but can be completely collapsed and folded when empty.

The interior 110 of the athletic equipment bag 105, in an exemplary embodiment, is provided with a securing member that enables the bat sack 120 to be removably securely connected to a portion of the interior 110. In an exemplary embodiment, the interior 110 has a piece of "hook and loop" material near the access 115. The bat sack 120 is provided with a mating piece of "hook and loop" material, in this exemplary embodiment, such that when the bat sack 120 is inserted into the interior 110 via the access 115, it can be secured to the "hook and loop" material attached to a portion of the interior 110. In this exemplary embodiment, the bat sack 120 is fastened to the athletic equipment bag 105 when placed in the interior 110, and is then unfastened when the bat sack 120 is removed from the athletic equipment bag 105. In an alternative embodiment, the interior 110 and the bat sack 120 has mating snaps which allow the bat sack 120 to be removably securely connected to the interior 110 of the athletic equipment bag 105.

Figure 2:
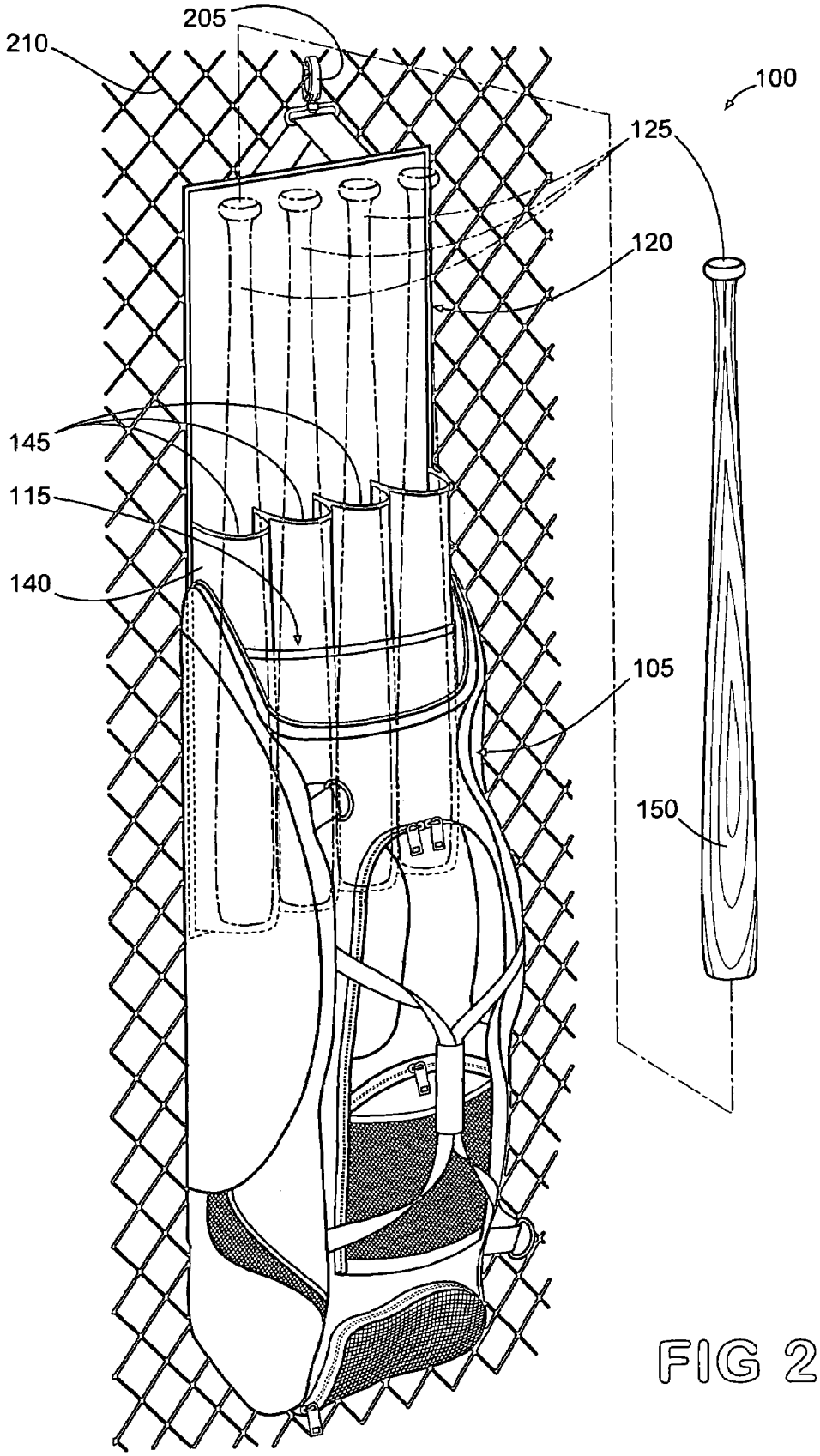
FIG. 2 is an illustration of a bat access and storage device in a suspended position in accordance with some embodiments of the present invention.

FIG. 2 is an illustration of one of the configurations of the bat access and storage device 100, in which the bat sack 120 has been partially removed from the athletic equipment bag 105. As previously provided, the bat sack 120 can be inserted or removed from the athletic equipment bag 105 via access 115 in an exemplary embodiment. In an embodiment depicted in FIG. 2, the bat sack 120 has been only partially removed from the athletic equipment bag 105. As shown in FIG. 2, the bat sack 120 in an exemplary embodiment is provided with a structural attachment device 205 that enables the bat sack 120 to be suspended from a supporting structure 210. In an exemplary embodiment depicted in FIG. 2, the structural attachment device 205 is a fence clip and the supporting structure 210 is a chain link fence. In an alternative embodiment, the structural attachment device 205 is a hook enabled to wrap around a supporting structure 210, such as chain link fence, and support the weight of the bat sack 120. Those skilled in the art will appreciate that the shape, dimensions, or implementation of the structural attachment device 205 can be altered without departing from the scope of the invention. Additionally, the supporting structure 210 can be various structures including, but not limited to, a wooden fence, a lattice, a wire, a pole, or any structure capable of supporting the weight of the bat sack 120. The supporting structure 210 could also be tripod or other mounting apparatus carried by the bat access and storage device 100.

In an exemplary embodiment depicted in FIG. 2, the athletic equipment bag 105 has been suspended from the supporting structure 210. Furthermore, the bat sack 120 has been partially removed from the athletic equipment bag 105 and suspended above the athletic equipment bag 105 on the supporting structure 210 by the structural attachment device 205.

The bat sack 120 depicted in FIG. 2 has a bat receptacle 140 made up of multiple sleeves 145 for storing bats 125. As previously described, the sleeves 145 in an exemplary embodiment are configured to cover at least the barrel 150 of the bat. In another exemplary embodiment, the sleeves 145 cover only the barrel 150 of the bat.

The configuration of an exemplary embodiment depicted in FIG. 2 provides numerous advantages to the athlete. This configuration allows concise and convenient storage to the majority of the athlete's baseball or softball equipment. Athletes can hang their equipment from the supporting structure 210 in one small area, instead of occupying a large amount of space in or around the dugout. Space conversation is important, as it is common for many athletes to share a small dugout or team area. It has been described that baseball and softball are unique sports in that they require the athlete to change equipment at every change in offensive possession in the game. The configuration depicted in FIG. 2, enables athletes to quickly and conveniently access their equipment during these changes of possession and before or after the game. In particular, athletes can quickly grab one of the bats 125 from the bat sack 120 when it is their turn to bat. In an exemplary embodiment, the bats 125 are substantially exposed as only their barrels are covered by the sleeves 145. The exposed nature of the bats 125, in the exemplary embodiment, allows the athlete to quickly grab a bat from the bat sack 120. Similarly, the sleeves 145 allow the athlete to quickly insert a bat into the bat sack 120.

The exposed nature of the bats 125, in an exemplary embodiment, also enables athletes to quickly recognize which of the bats 125 is the one desired. As the athletes' focus on specialized equipment continues to increase, so does the athletes' reliance on particular equipment for particular situations. In a non-limiting example, if a pitcher is throwing off-speed pitches, the athlete may desire a light bat for a quick response. Later in the game, the pitcher may change his/her throwing style to a fast-ball approach, in which the athlete may desire a heavier bat. The athletes' hitting needs are likely to change rapidly during the course of the game; thus, athletes need the ability to quickly discern which of the bats 125 in the bat sack 120 is desired for a given situation.

Figure 3:
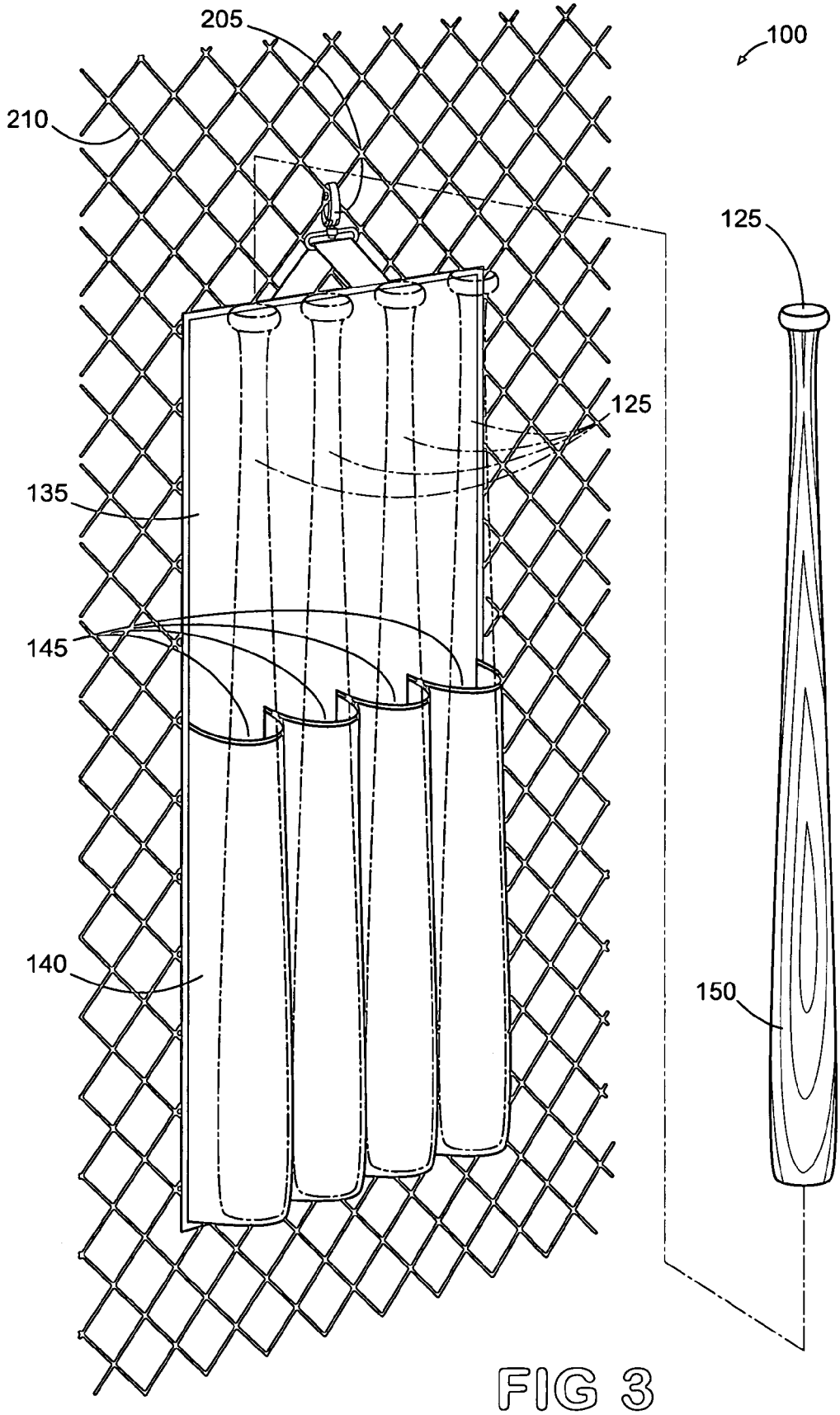
FIG. 3 is an illustration of a bat access and storage device in a suspended position in accordance with some embodiments of the present invention.

FIG. 3 is an illustration of an alternative exemplary embodiment of the bat access and storage device 100. In this exemplary embodiment, the bat access and storage device 100 has a general body 135 and a bat receptacle 140 attached to the body 135. In this exemplary embodiment, the bat access and storage device 100 does not necessarily include an athletic equipment bag 105 (FIG. 1). The bat receptacle 140, in an exemplary embodiment, is adapted to enable multiple bats 125 to be received. In an exemplary embodiment, the bat receptacle 140 is enabled to expose a substantial portion of the bats 125 to provide rapid access to the bats 125. Additionally, the bat access and storage device 100 in the exemplary embodiment depicted in FIG. 3 further contains a structural attachment device 205 in communication with the general body 135. This structural attachment device 205, in an exemplary embodiment, enables the general body 135 and bat receptacle 140 to be suspended from a supporting structure 210.

In an exemplary embodiment, the structural attachment device 205 is a fence clip and the supporting structure 210 is a chain link fence. In an alternative embodiment, the structural attachment device 205 is a hook enabled to be attached to the supporting structure 210. Those skilled in the art will appreciate that the shape, dimensions, or implementation of the structural attachment device 205 can be altered without departing from the scope of the invention. Additionally, the supporting structure 210 can be various structures including, but not limited to, a wooden fence, a lattice, a wire, a pole, or any structure capable of supporting the bat access and storage device 100.

In an exemplary embodiment, the general body 135 and bat receptacle 140 are suspended such that the bats 125 are in a substantially vertical position, as shown in FIG. 3. In this exemplary embodiment, the athletes will most often retrieve one of the bats 125 by grabbing a handle and lifting the bat out of the bat receptacle 140. In another exemplary embodiment, the general body 135 and bat receptacle 140 are suspended such that the bats 125 are in a substantially horizontal position. In this exemplary embodiment, the bat receptacle 140 enables the athlete to remove one of the bats 125 by pulling it from the bat receptacle 140 in horizontal direction. Those skilled in the art will appreciate that the manner, direction, or position of the suspended general body 135 and bat receptacle 140 can be altered without departing from the scope of the invention.

In an exemplary embodiment, the bat receptacle 140 has a number of sleeves 145 enabled to store one of the bats 125. An exemplary embodiment provides a bat receptacle 140 with multiple sleeves 145, and each of sleeves 145 is enabled to cover at least the barrel 150 of each of the bats 125. As previously discussed, covering the barrel 150 of the bat provides sufficient control over the bat while providing ample exposure of the bat for convenient access. A sleeve the full length of the bat requires the cumbersome manipulation of the bat by threading it through the entire sleeve when inserting it, and pulling the full length of the bat from the entire sleeve when removing it. The same is true for an athletic equipment bag with a bat storage compartment, which requires the full length of the bat to be inserted or the full length of the bat to be removed. Full coverage does not provide rapid access. On the other hand, in this exemplary embodiment, bats 125 can be rapidly inserted and removed because only a portion of the bat is encapsulated by the one of the sleeves 145. In an alternative embodiment, the bat receptacle 140 is one large compartment capable of storing multiple bats 125. In another embodiment, the bat receptacle 140 is simply series of clips to which either the upper, middle, or lower portion of the bats 125 can be attached. One of skill in the art will appreciate that the bat receptacle 140 depicted in the exemplary embodiment shown in FIG. 3 could be provided in numerous other ways without detracting from the scope of the invention.

The exemplary embodiment of the bat access and storage device 100 depicted in FIG. 3 provides an expedient and readily available storage system for the athlete. The structural attachment device 210 attached to the general body 135 enables the general body 135 and bat receptacle 140 to be suspended in any convenient location desired. In a non-limiting example, the athlete can suspend the general body 135 and bat receptacle 140 inside the dugout for quick and convenient access during the game or practice. In other examples, the general body 135 and bat receptacle 140 can be suspended on the outside of the dugout, along the foul-line fence, or even inside the playing field, possibly near the on-deck circle.

Stray bats in the playing area and dugout can cause a hazard and can often result in penalties, or even injuries, in the game. It is important to keep the base running area, batter's box, and on-deck circle clear of any loose bats to prevent an athlete from tripping over a bat. Loose bats can lead to serious injuries when errantly contacted during a play. The bat access and storage device 100 provides athletes with an efficient and convenient way to store bats 125 during play and keep the playing areas safe and free of stray bats.

In an exemplary embodiment, the bat access and storage device 100 can be used as the central repository of the bats 125 for the entire team or a number of team players. In a non-limiting example, the bat access and storage device 100 can be suspended on the supporting structure 210 near the dugout door. The bats 125 to be used by the team, during a particular game or practice, can be stored in the bat receptacle 140. This configuration allows the athletes to quickly remove a desired bat from the bat receptacle 140 when it is their turn to bat and re-insert the bat into the bat receptacle 140 after the end of their offensive possession. Instead of the bats 125 being errantly placed near the batter's box, on-deck circle, or in the dugout, the bats 125 are neatly and conveniently stored in bat receptacle 140 near the dugout door.

While the various embodiments of this invention have been described in detail with particular reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all applicable equivalents.

What is claimed is:

1. A baseball equipment bag comprising:

an elongate body having a substantially flat rigid back surface, flexible front and side surfaces, a closed bottom end, and an open top end, the body having a longitudinal axis passing through the top and bottom ends;

a first attachment member for attaching the bag to a vertical structure such that the longitudinal axis is oriented substantially vertical;

an interior compartment defined by the body;

a divider disposed with the interior compartment spanning the sides of the bag along substantially the entire length of the interior compartment, the divider oriented substantially parallel to the longitudinal axis;

a bat compartment defined by the back surface, side surfaces, and divider;

an equipment compartment defined by the front surface, side surfaces, and divider;

a bat holder having a substantially rigid base surface and first and second semi-cylindrical sleeves disposed on the base surface, the first and second sleeves each adapted to receive the barrel of a baseball bat, the bat holder having a second attachment member for attaching the bat holder to a vertical structure, wherein the bat holder with a baseball bat placed in each of the first and second sleeves is stored in the bat compartment and removed from the bag through the open end.

2. A baseball or softball equipment bat comprising:

an elongate body having a substantially flat rigid back surface, flexible front and side surfaces, a closed bottom end, and an open top end, the body having a longitudinal axis passing through the top and bottom ends;

a first attachment member for attaching the bag to a vertical structure such that the longitudinal axis is oriented substantially vertical;

an interior compartment defined by the body;

a bat holder having a substantially rigid base surface and first and second semi-cylindrical sleeves disposed on the base surface, the first and second sleeves each adapted to receive the barrel of a bat used for playing baseball or softball, the bat holder having a second attachment member for attaching the bat holder to a vertical structure, wherein the bat holder with a baseball bat placed in each of the first and second sleeves is stored in the interior compartment and removed from the bag through the open end; and a third attachment member detachably securing the bat holder to the interior compartment.

3. The baseball equipment bag of claim 2, wherein the second attachment member is a fence clip enabled to be clipped to said vertical structure.

4. The baseball equipment bag of claim 2, wherein the second attachment member is a hook enabled to be attached to said vertical structure.

5. The baseball equipment bag of claim 1, the bat holder having a length at least equivalent to the length of a bat used for playing the sport of baseball or softball.

6. The baseball equipment bag of claim 1, wherein said base surface of said bat holder is generally of a rectangular profile of sufficient rigidity to maintain its profile when said holder is empty.

7. The baseball equipment bag of claim 1, further including a securing member enabling said bat holder and a portion of said bat compartment to be removably securely connected.

* * * * *